United States Patent [19]

McDonald

[11] 4,343,056

[45] Aug. 10, 1982

[54] MAN-OVERBOARD RESCUE APPARATUS FOR SAILBOATS

[76] Inventor: Charles D. McDonald, 7906 Royal La., Dallas, Tex. 75230

[21] Appl. No.: 146,505

[22] Filed: May 5, 1980

[51] Int. Cl.[3] ..... B63C 9/00

[52] U.S. Cl. ..... 441/84; 182/3

[58] Field of Search ..... 114/255, 97, 39, 102; 9/14; 43/7, 8, 27.4; 182/3, 5

[56] References Cited

U.S. PATENT DOCUMENTS

| | | | |
|---|---|---|---|
| 550,343 | 11/1895 | Greener | 9/14 |
| 1,282,323 | 10/1918 | Trinkle | 9/14 |
| 2,700,781 | 2/1955 | Smith | 9/14 |

FOREIGN PATENT DOCUMENTS

| | | | |
|---|---|---|---|
| 716635 | 10/1954 | United Kingdom | 9/14 |

*Primary Examiner*—Trygve M. Blix
*Assistant Examiner*—Thomas J. Brahan
*Attorney, Agent, or Firm*—C. Douglas McDonald, Jr.

[57] ABSTRACT

A man overboard rescue device for use on a sailboat having a mast supported by shrouds includes a boom, structure for attaching the boom to the shrouds, a recovery line having one end attached to the boat and the other end fed through a guide attached adjacent the outer end of the boom, a sling arrangement attached to the other end of the recovery line and a container with a selectively openable closure and attached to the boat for releasably containing the sling and the portion of the recovery line adjacent the sling.

5 Claims, 4 Drawing Figures

MAN-OVERBOARD RESCUE APPARATUS FOR SAILBOATS

BACKGROUND OF THE INVENTION

This invention relates generally to safety equipment for boating use, and more particularly for use on sailboats. More specifically, the invention relates to such apparatus for rescuing persons overboard and simplifying the recovery of such persons.

The loss of persons overboard has long been a danger associated with boating activities. In the best of conditions, with warm water and calm seas, it is generally possible to recover such persons either through the use of boarding ladders or by assistance of those on board. For lifting the persons aboard in such conditions, one technique used with sailboats has employed a sail-hoisting halyard for attaching to a safety harness or sling worn by the person overboard, with the use of a winch in conjunction with that halyard for hoisting the persons aboard. Such technique, however, requires either the availability of a spare halyard, or that at least one of the sails be dropped and secured to free a halyard for such use. Further, in rough seas the rolling and pitching of the boat may cause wild gyrations of the mast head from which the halyard extends, thus causing severe jerking and large scale movement of the halyard. Such movement may render it difficult to get the halyard to the person in the water, and, if successful, may subsequently result in slamming that person against the side of the boat during the recovery process. This technique, as well as the use of boarding ladders, requires substantial physical exertion by the person being rescued. If the water is cold, as is often the case in oceans, or if the person is only partially conscious, rescue efforts using these techniques may be totally frustrated.

Where seas are relatively calm and the person in the water disabled, it is also known to maneuver a portion of the sail, while still attached to the boom and halyard, under the person in the water to form a sling to lift the person aboard. Obviously such a technique can be extremely impractical and highly dangerous in situations in which there is substantial wind blowing.

Other known apparatus includes structures such as davits permanently affixed to both decks and carrying a rescue sling and rope for use by the person overboard. While such apparatus performs satisfactorily on power boats, the extremely limited deck space and potential interference with sails, particularly large overlapping jibs, render such structure completely unsuited for use on most sailboats. Accordingly, most sailboats carry only throwable flotation devices, frequently attached to marker buoys, and have little if any provision for bringing a person aboard in hostile conditions. This problem is particularly acute in larger sailboats in which the desk may be six to eight feet above the water, thus making it virtually impossible to reach the person in the water directly.

SUMMARY OF THE INVENTION

It is an object of the present invention to provide rescue apparatus for use on sailboats which simplifies the recovery of persons overboard. It is a further object of this invention to provide such apparatus which is compact and provides minimal interference to the usable deck area of such a boat. It is yet another object of this invention to provide such apparatus which is simple to use and susceptible of quick deployment and use.

To achieve these and other objects, which will become apparent below, there is provided man-overboard rescue apparatus for use on sailboats having at least one mast supported by shrouds on both sides of the boat and extending from a point at least partway up the mast to a point adjacent the deck. This rescue apparatus includes a boom structure having an inner end mounted to the shrouds on one side of the boat for movement between a stowed position, generally parallel to said shrouds, and an extended position with the outer end of said boom structure projecting outboard of the shroud, mounting means attaching said boom means to said shrouds and provided for said movement between said stowed position and said extended position, a recovery line having one end attached to said boat and the other end being fed through guide means positioned adjacent said boom means outer end and into sling means adapted to encircle the chest of the man overboard, and container means attached to said boat for releasably containing said sling means and the portion of said recovery line adjacent said sling means, said container means having selectively openable closure means. In the closed configuration of the container means, there is substantially complete enclosure for said sling means and the adjacent recovery line portion, and in the open configuration, there is provision for quick removal of said sling and said recovery line portion therefrom.

BRIEF DESCRIPTION OF THE DRAWINGS

A particularly preferred embodiment of the rescue apparatus of this invention will be described in detail below, in which.

DESCRIPTION OF A PREFERRED EMBODIMENT

Figure 1:
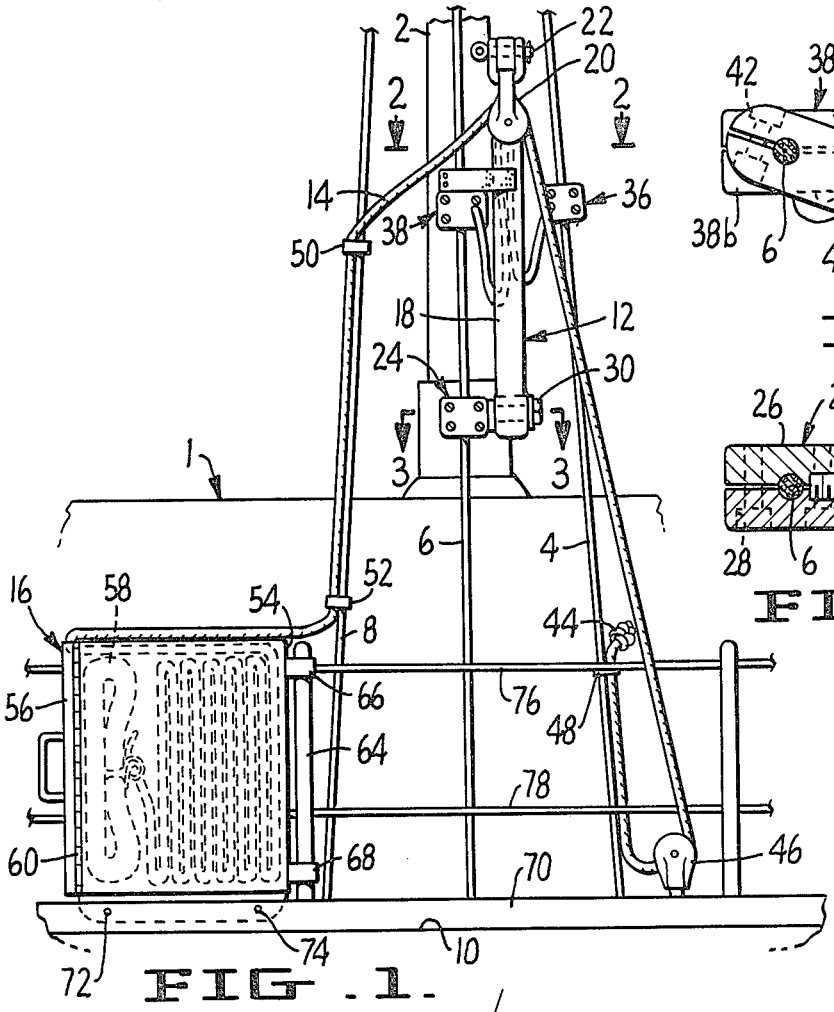
FIG. 1 is a side elevational view of the apparatus of this invention in its stowed configuration.
Figure 4:
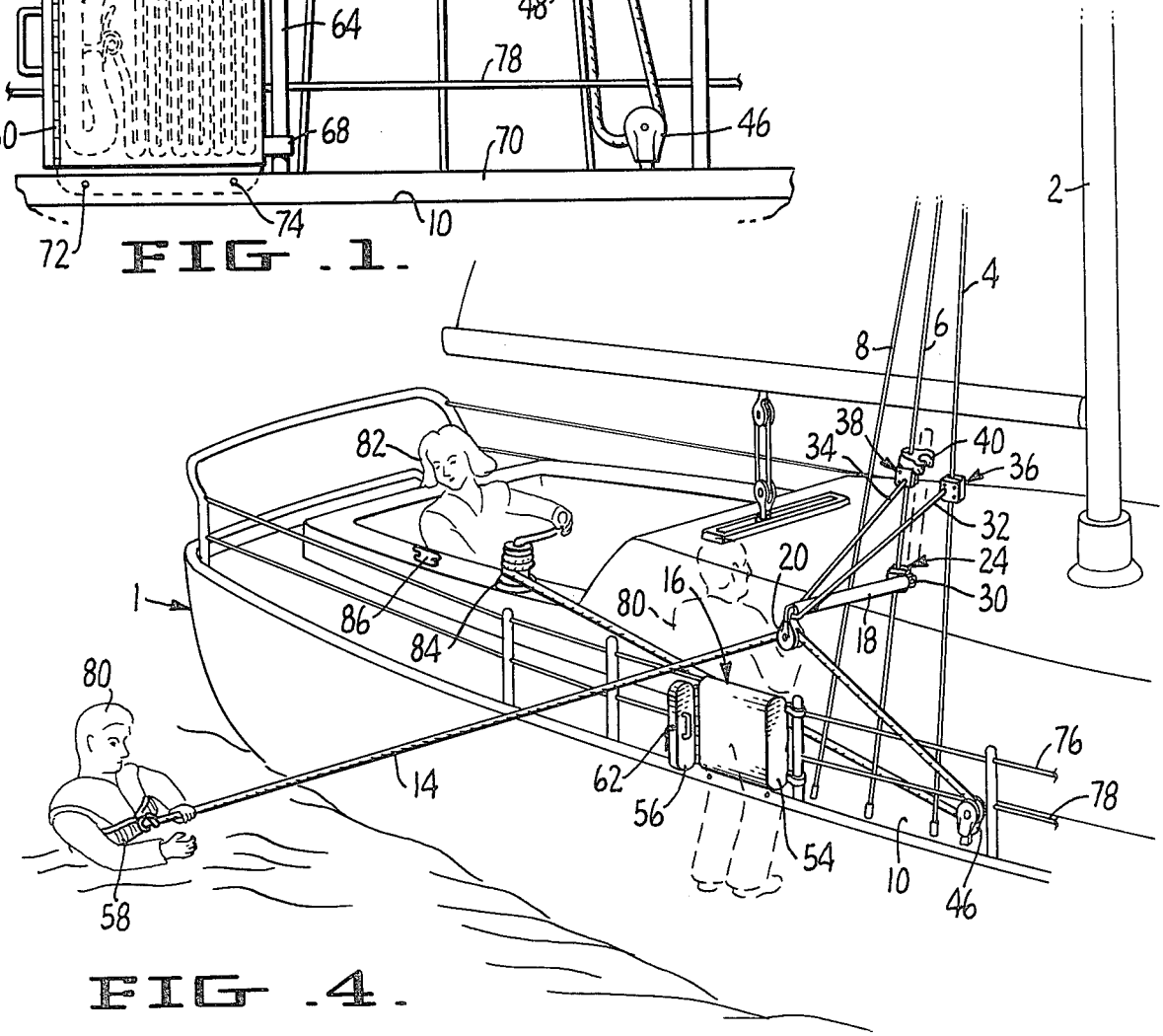
FIG. 4 is a pictorial representation of the apparatus of FIG. 1 in its extended configuration illustrating the use thereof.

A particularly preferred embodiment of the rescue apparatus of this invention is illustrated in the elevational view of FIG. 1, with the apparatus in its stowed configuration and in the pictorial view of FIG. 4 with the apparatus in its extended configuration. This apparatus is intended for use on a sailboat 1 having at least one mast 2 supported by a plurality of shrouds 4, 6 and 8 on both the port and starboard sides of the boat, these shrouds extend from a point at least partway up the mast 2 to a point adjacent the boat deck 10. While the illustration of FIG. 4 depicts the apparatus of this invention as mounted to a sloop-rigged boat 1, it should be obvious that the apparatus is equally applicable to any other type of rig in which the mast is supported by shrouds.

In the preferred embodiment, the basic components, which, in general, are formed preferably of stainless steel or aluminum, include a boom arrangement 12, a recovery line 14 and a container 16, all of which will be described in greater detail below. The boom arrangement 12 includes boom member 18, which may suitably be formed of aluminum tubing, and a guiding pulley block 20 attached, preferably by a pivoting and swiveling connection 22, to one end of the boom 18 which will be defined as the outer end. The opposite end of boom 18, defined as the inner end, is pivotally attached to shroud 6, which may conveniently be the upper shroud, by a pivotal attaching structure generally denoted by reference numeral 24, and illustrated in the sectional view of FIG. 3.

Figure 3:
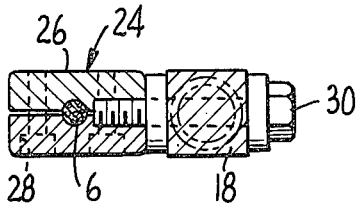
FIG. 3 is a sectional plan view of the pivotal mounting means for the apparatus of FIG. 1, taken along line 3—3.

Pivotal attaching structure 24 may suitably include a cable clamping member 26 which is clamped by tightening cap screw 28, shown in phantom, to hold firmly to shroud 6, which conventionally is of either steel rod or stainless steel cable. A pivoting attachment 30 extends through the inner end of boom 18 and is affixed to the clamping member 26, suitably as shown in FIG. 3. This arrangement provides for pivotal movement of the boom 18 between the stowed position with the outer end thereof projecting upwardly, as illustrated in FIG. 1, and an extended position with the outer end projecting outboard of the shrouds, as depicted in FIG. 4.

Figure 2:
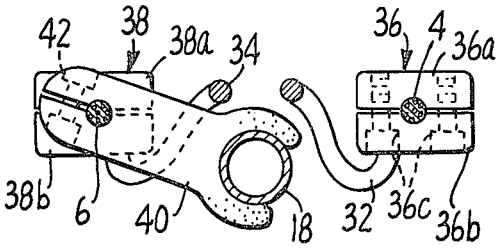
FIG. 2 is a plan view of a portion of the apparatus of FIG. 1, taken along line 2—2.

When the boom arm 18 is pivoted to its extended position (FIG. 4), the outer end of the boom arm 18 is supported by lines or cables 32 and 34 attached to mounting devices 36 and 38, respectively, and thence to mutually adjacent shrouds 4 and 6. Obviously, if desired, the mounting device 38 and/or the pivotal attaching structure 24 could be attached to shroud 8 instead of shroud 6. The mounting device 36 may suitably be formed as illustrated in FIG. 2, comprising two halves, 36*a* and 36*b*, suitably formed of aluminum, clampingly secured to shroud 4 by the clamping effect of cap screws 36*c* joining the two halves. Likewise, mounting device 38 comprises two halves 38*a* and 38*b*, similarly clamped to shroud 6. The supporting lines 32 and 34 may preferably be stainless steel cable or other strong lines and may be attached to the mounting devices 36 and 38 in any conventional manner.

Attached to shroud 6 adjacent the mounting device 38 in the illustrated embodiment is a boom arm retaining clip 40 which may be formed of a suitable synthetic resin or a relatively rigid, resilient rubber, clamped to shroud 6 by a bolt and nut combination 42, illustrated in phantom in FIG. 2. The purpose of this clip is to releasably hold the boom arm 18 in the stowed position of FIG. 1 while providing for quick release by a pull on the boom arm 18.

Recovery line 14 has one end attached to the boat so that it cannot be pulled overboard. This end suitably may have a knot 44 tied in the end, which knot is too large to fit through the block 46, so that this end of the line 14 can be pulled no farther out than the point where the knot 44 engages block 46. Suitably, this end of the rope may be releasably attached to one of the shrouds by a suitable clip 48 to hold it up from the block 46 for more convenient access.

From block 46 recovery line 14 is fed through the guide means, suitably pulley 20, attached adjacent the boom arm 18 outer end and thence downwardly to container 16. Suitably, additional clips 50 and 52 may be provided to releasably hold the line 14 to one of the shrouds, such as shroud 8, as shown in FIG. 1. The line 14 is then fed through a small aperture into the interior of the cannister portion 54 of cannister 16 and then to the end of that cannister 54 remote from the door 56, where it is then flaked or packed in a zig-zag manner, as shown in phantom in FIG. 1, within the cannister. The end of the line 14 opposite that having the knot 44 is then attached to an adjustable sling 58 which is adapted to be placed around and thus encircle the chest of a user, such as a person overboard. This sling, which may be formed of a nylon webbing material, may also have attached to it a resilient flotation material, such as a foamed synthetic resin, to provide for both cushioning the sling about a wearer and also for providing additional flotation in the manner of a life belt.

Both the flaked portion of the recovery line 14 and also the sling 58 are completely enclosed within the container 16 when the door 56 is closed. Door 56 suitably is attached to cannister portion 54 of the container 16 by means of a hinge 60 extending along one side, with a quick release closure fastening device 62 positioned on the opposite side. This closure device 62 may be of any suitable type, such as a pin with a pull ring or other conventional quick opening latching arrangement, to facilitate quick opening of the door 56 when desired while holding it firmly closed at other times.

The cannister portion 54 of the container 16 may be firmly but removably attached both to life line stanchion 64 by means of suitable clamps 66 and 68 and also to either the toe rail 70 attached to the deck 10 and hull of the boat or directly to the deck 10. In FIG. 1 the cannister is shown attached to the toe rail 70 by conventional and well known fasteners 72 and 74. If desired, the cannister may also be attached by suitable clamps to the life lines 76 and 78. It is preferred to have the cannister mounted outside the life lines to provide for least obstruction of usable deck space and also to maximize the freedom of discharge of the line from the container 16 when it is needed.

The general manner of use of the apparatus of this invention may be seen with reference to FIG. 4 of the illustrations. When a person, such as man 80 in FIG. 4, goes overboard, one of the persons 82 remaining aboard the boat may go forward to the container 16 and activate the quick release closure 62 and swing the door 56 to its open position illustrated in FIG. 4. That person 82 may than grasp the sling 58, pull it from the container 16 and hurl it either directly to the person 80 overboard or out to the side of the boat to be subsequently drawn to that person. By virtue of the flaked arrangement of the recovery line 14 within the cannister 54, that line will quickly be fed from the cannister with no twist imparted thereto. If the line 14, or at least the portion which is housed within the cannister 54, is of a polypropylene material, both the line and also the buoyant sling 58 will float on the surface of the water, thus making the sling and line more readily visible to the person in the water. Of course, if desired, a small rescue light may also be attached to the sling 58 to facilitate spotting by the person in the water in times of reduced visibility, such as at night.

If it is not possible to throw the sling directly to the person in the water, the boat 1, preferably with its sails down, may then be circled about that person 80 to bring the line 14 and sling 58 to him. During this time it is also desirable for the person on board the boat to pull the end of the recovery line 14 having the knot 44 therein free from its clip to the shroud 4 and bring it back to a switch 84, which may suitably be one of the sheet winches of the sailboat.

As soon as the adjustable sling 58 is brought to the person 80 in the water, that person may then slip it over his head and arm and place it around his chest just below the arms, allowing the sling to self-adjust to a snug fit around his chest. At this point he is not only secured to the boat but is also provided with additional flotation provided by the flotation material attached to the sling 58. When the person 80 in the water exerts a pull on the recovery line 14, the line will pop free from the clips 50 and 52 and, with the opposite end of the line held by the person 82 on board, will cause the boom arm 18 to pop free from its clip 40 and drop to the extended position illustrated in FIG. 4, supported by the lines 32 and 34 and the mounting devices 36 and 38.

With the boom extended, projecting outboard of the spreaders and suitably just slightly outboard of the side of the hull of the boat 1, the person 82 on board may then draw in the recovery line 14 by operation of the winch 84. Such a winch, while not necessary for the operation of this invention, provides a greatly increased mechanical advantage, thus permitting a relatively small person to pull a relatively large person from the water. When the recovery line 14 has been drawn in sufficiently to bring the attachment between the line 14 and sling 58 to a point adjacent the guiding pulley block 20 at the end of boom arm 18, as depicted by the phantom line representation of the person 80 in FIG. 4, the recovery line 14 may then be snubbed or fastened, suitably about cleat 86, to secure the line 14. Then, the person 82 aboard the boat may go forward to the boom 18 and pivot the boom 18 about the axis defined by shroud 6 to swing the person 80 forward, lifting his legs over the life lines 76 and 78, thus positioning the rescued person above the deck 10 of the boat 1. By having both the pivotal mounting 24 and the mounting device 38 attached to one of the shrouds 6, and the other mounting device 36 attached to an adjacent shroud 4, suitably forward of shroud 6, the shroud 6 defines a roughly vertical pivot axis for swinging the rescued person 80 aboard. The mounting device 36 and its line 32 to the end of boom arm 18 restrains the boom against swinging rearwardly during the rescue operation, thus serving to hold the boom arm 18 projecting outward from the boat.

With the rescued person 80 now supported above the deck 10 of the boat, the person 82 on board may then turn to the cockpit and release the line 14 from its engagement with cleat 86 and lower the rescued person 80 to the deck, thus completing recovery of the man overboard.

Numerous variations and modifications of the apparatus of this invention will readily occur to those skilled in the art. Such modifications and variations include not only different types and forms of the container for the recovery line and sling, but also different forms and techniques for mounting the boom to the shrouds, as well as numerous variations in the configuration and materials of the various devices. Accordingly, while the foregoing description illustrates a particularly preferred embodiment of the apparatus of this invention, it is to be understood that this detailed description is for purposes of illustration only and is not to be considered limitative of the scope of this invention. The scope of this invention is to be defined solely by the claims appended hereto.

What is claimed is:

1. Man-overboard rescue apparatus for use on a sailboat having at least one mast supported by shrouds on both the port and starboard sides of the boat extending from a point at least part way up the mast to a point adjacent the boat deck, said apparatus comprising boom means;

mounting means for attaching said boom to said shrouds on one side of the boat and providing for movement of said boom means between a stowed position generally parallel to said shrouds and an extended position with the outer end of said boom means projecting outboard of said shrouds;

a recovery line having one end attached to said boat and the other end being fed through guide means attached adjacent said boom means outer end;

sling means attached to said recovery line other end and being adapted to encircle the chest of the man overboard;

container means attached to said boat for releasably containing said sling means and the portion of said recovery line adjacent said sling means, said container means having selectively openable closure means which, in its closed configuration, provides for substantially complete enclosure for said sling means and said recovery line portion and, in its open configuration, provides for quick removal of said sling and said recovery line portion therefrom, whereby the container may be opened and the sling and recovery line quickly removed therefrom and tossed to the man overboard.

2. The rescue apparatus of claim 1 wherein said mast is supported by at least two shrouds on each side of said boat and wherein said mounting means comprises pivoting means attached to one of said shrouds for pivotally supporting the inner end of said boom means, and supporting means attached to at least one other said shroud for supporting said boom means outer end in said extended position.

3. The rescue apparatus of claim 2 further comprising means for releasably holding said boom means in said stowed position with said boom means outer end extending generally upwardly.

4. The rescue apparatus of claim 1 further comprising means for attaching said container means to said boat deck.

5. The rescue apparatus of claim 1 wherein said guide means attached to said boom means outer end comprises a pulley block pivotally attached to said boom means.

* * * * *